United States Patent [19]

Tamba et al.

[11] Patent Number: 4,756,280

[45] Date of Patent: Jul. 12, 1988

[54] COOLING SYSTEM FOR VERTICAL SHAFT V-TYPE ENGINE

[75] Inventors: Shinichi Tamba; Noboru Fukui, both of Kakogawa; Akio Miguchi, Kobe, all of Japan

[73] Assignee: Kawasaki Jukogyo Kabushiki Kaisha, Kobe, Japan

[21] Appl. No.: 70,101

[22] Filed: Jul. 1, 1987

Related U.S. Application Data

[63] Continuation of Ser. No. 808,294, Dec. 12, 1985, abandoned.

[30] Foreign Application Priority Data

Dec. 21, 1984 [JP] Japan ..... 59-271348
Sep. 9, 1985 [JP] Japan ..... 60-198882

[51] Int. Cl.[4] ..... F01P 5/10
[52] U.S. Cl. ..... 123/41.47; 123/196 W
[58] Field of Search ..... 123/41.44, 41.46, 41.47, 123/196 W

[56] References Cited

U.S. PATENT DOCUMENTS

| | | | |
|---|---|---|---|
| 1,335,990 | 4/1920 | Short | 123/41.47 |
| 2,074,702 | 3/1937 | MacClatchie | 123/41.47 |
| 3,001,517 | 9/1961 | Baker et al. | 123/41.47 |
| 3,730,147 | 5/1973 | Buchwald | 123/41.44 |
| 4,565,163 | 1/1986 | Ishimi et al. | 123/41.44 |

*Primary Examiner*—Willis R. Wolfe
*Assistant Examiner*—Eric R. Carlberg

[57] ABSTRACT

A cooling system for V-type engine comprises rows of left and right cylinders arranged in V-type and having coolant jackets, respectively. A coolant pump having a pump shaft parallel to a crankshaft is arranged with a V-bank and at a place away from each cylinder in an axial direction of said crankshaft, and coolant jacket inlets are provided on the side of the coolant pump of each cylinder. Alternately, the coolant jacket inlets of the cylinders are opened respectively at one end face in the direction of the crankshaft of a crankcase-forming member, and a distributing exit passage is defined by joint faces of said crankcase-forming member, a pump casing and a pump casing cover respectively.

5 Claims, 4 Drawing Sheets

COOLING SYSTEM FOR VERTICAL SHAFT V-TYPE ENGINE

This application is a continuation of application Ser. No. 808,294, filed Dec. 12, 1985, now abandoned.

BACKGROUND OF THE INVENTION

1. Field of the Invention

This invention relates to cooling system for V-type engine in which rows of left and right cylinders are arranged in V-type, and particularly, to arrangements of a coolant pump of said cooling system, and of a connection portion between said coolant pump and coolant jackets of each cylinder.

2. Description of the Prior Art

Such arrangement of the coolant pump in the cooling system for V-type engine has been disclosed, for example in Japanese Utility Model Laid-open Nos. 58-137,818 and 55-73,515.

In the Japanese Utility Model Laid-open No. 58-137,818, there are problems in that a coolant pump has been provided within a V-bank defined between left and right cylinders, so that the known cooling system requires a large space of the V-bank and applies to only a relatively large engine, and that a coolant passage of each cylinder is divided into cylinder blocks, so that there is a tendency to increase the manufacturing cost of the cylinder block, because it could be used as a core in a moulding of said cylinder blocks. Also, in the Japanese Utility Model Laid-open No. 55-73,515, there is a problem that the coolant pump has been provided between the cylinders, so that it would increase the top angle of the V-bank (crossing angle of the cylinders).

Furthermore, in the prior arrangement disclosed in these references, in any case, the coolant pump is provided between the cylinders, thereby the V-type engine would be very complicated by providing other component parts, for example fuel pump, carburetor, control system and the like in a space between the V-bank, and would be difficult to maintain. Particularly, in OHV-type engine, a push rod is arranged within the V-bank, so that the construction would be considerably complicated.

SUMMARY OF THE INVENTION

It is main object of the invention to provide a cooling system for a V-type engine which is constructed in such a manner that a coolant pump is provided by using an excess space in a wall surface of the crankcase away from a space defined in the V-bank, and that coolant jacket inlets are formed on the side of the coolant pump of each cylinder, said cooling system being able to be made compactly, decreases the manufacturing cost and results in easy maintenance thereof.

It is another object of the invention to provide a cooling system for a V-type engine formed compactly and less costly as a whole, which is formed with a distributing exit passage by using mutual joint faces of a crankcase-forming member (that is, crankcase cover), pump casing and pump cover.

In a first aspect of the invention, the above main object is achieved by means of a cooling system of the type mentioned in the opening paragraph, which is characterized in that a coolant pump having a pump shaft parallel to a crankshaft is arranged within the V-bank and at a place away from each cylinder in an axial direction of said crankshaft, coolant jacket inlets are provided on the side of the coolant pump of each cylinder, and exit ports of the coolant pump are connected to each coolant jacket inlet.

In a second aspect of the invention, the above object is achieved by means of a cooling system of the type mentioned in the opening paragraph, which is characterized in that a coolant pump having a pump shaft parallel to a crankshaft is arranged within the V-bank and at a place away from each cylinder in an axial direction of said crankshaft, coolant jacket inlets of the cylinders are opened respectively at one end face in the direction of the crankshaft of a crankcase-forming member, a distributing exit passage is defined by joint faces of said crankcase-forming member, a pump casing and a pump casing cover, said passage extending from a suction port to the crankshaft in a substantially vertical direction and reaching to each coolant jacket.

BRIEF DESCRIPTION OF THE DRAWINGS

The invention will now be described in greater detail with respect to the cooling system for a V-type engine according to the invention with reference to the drawing in which.

DESCRIPTION OF THE PREFERRED EMBODIMENTS

While the present invention will be described more fully hereinafter with reference to the accompanying drawings, in which particular embodiments of the present invention are shown, it is to be understood at the outset of the description which follows that persons of ordinary skill in the appropriate arts may modify the invention here described while still achieving the favorable results of this invention.

Figure 1:
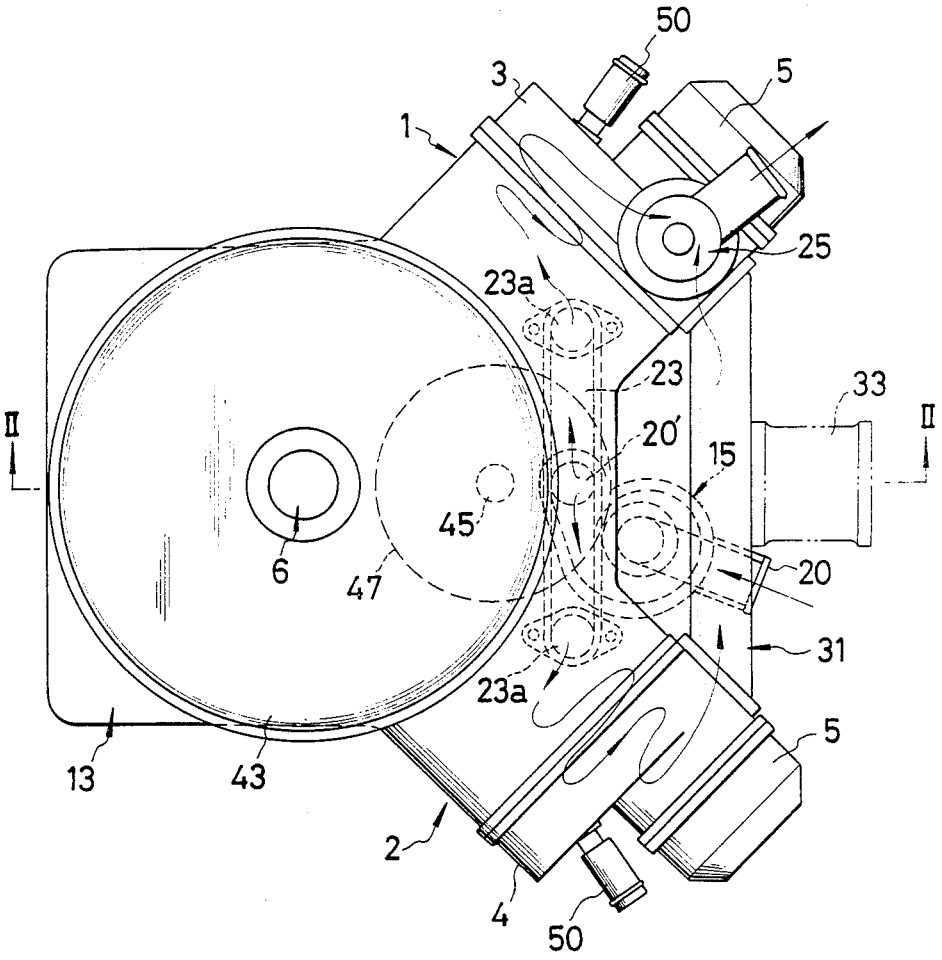
FIG. 1 is a plan view of a vertical shaft V-type liquid cooled engine, which is provided with the cooling system according to the invention.
Figure 2:
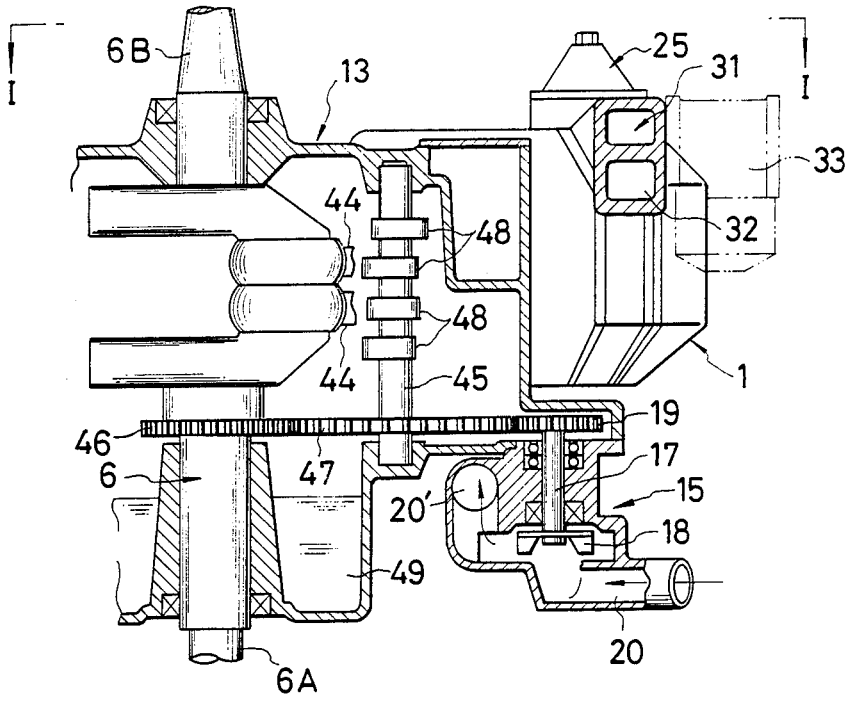
FIG. 2 is a vertical section view of a V-bank center portion taken on lines II—II of FIG. 1.

Referring now more specifically to the drawings, in FIGS.1 and 2, the engine has a crankshaft 6 extending vertically a pair of cylinders 1 and 2 which are arranged in parallel and in V-type at a given angle (for example 90°) at the side of the crankcase 13.

The left and right cylinders 1 and 2, respectively are provided with cylinder heads 3 and 4 and a head cover 5, and pistons mounted within the cylinders 1 and 2 (not shown in FIG.) are connected respectively to a crankpin of crankshaft 6 by a connecting rod 44.

An upper end 6B of the crankshaft 6 is provided with a flywheel 43 and other component parts and a lower end 6A of the crankshaft 6 forming an output shaft. As shown in FIG. 2, a camshaft 45 driven with the crankshaft 6 is pivotably supported within the crankcase 13. This camshaft 45 is provided between the left and right cylinders 1 and 2, or within the V-bank, and a driven gear 47 of said camshaft 45 is driven with rotation of a drive gear 46 mounted on the crankshaft 6. Moreover, numeral 48 shows a cam operating a push rod for driving intake and exhaust valves (not shown in FIG. 2) with predetermined proper timing.

A coolant pump 15 having an impeller 18 is driven through the drive gear 46, the driven gear 47 and a pump gear 19, but may be driven directly with the camshaft 45. Furthermore, an oil pan 49 is formed at a bottom portion of the crankcase 13 in such a manner that engine oil is reserved. Also, numeral 50 shows a spark plug secured on the cylinder head 3 (as shown in FIG. 1).

The cooling system for the V-type engine according to the invention has the coolant pump 15 on a wall of the lower end of the crankcase 13 in order to circulate the coolant (for example, water). As coolant pump 15 may be used, for example a centrifugal type.

A position fitting this coolant pump 15 is presented within the V-bank when looking in axial direction of the crankshaft 6 and from the cylinders 1 and 2, respectively (that is, over the wall of the lower end of the crankcase away downward). Said coolant pump is constituted in such a manner that the coolant is circulated by suction of said coolant from a suction port 20 and forced out from an exit port 20' in the direction of the arrows by a rotating movement of a pump drive shaft 17.

Coolant jacket inlets **23*a* of the cylinders 1 and 2 are provided at the side of the coolant pump 15, that is, at the underside of each cylinder in the embodiment shown in FIGS. 1 and 2. The exit port 20' of the coolant pump 15 is connected to the coolant jacket inlets 23*a* of each cylinder through a coolant inlet manifold 23 as shown in FIG. 1. The coolant jackets of each cylinder are formed in such a manner that a required portion between the cylinders and the cylinder heads is cooled. The coolant jacket exit port of the one cylinder (upperside in FIG. 1) is provided with a thermostat chamber 25. The coolant jacket exit port of the other cylinder (underside in FIG. 1) is connected to a coolant passage 31, which is communicated with said thermostat chamber 25. After the coolant is circulated to the coolant jackets of each cylinder 1, 2 and has cooled the engine as shown in FIG. 1, each circulating coolant is joined at the thermostat chamber 25 to control the jacket coolant temperature, after which said coolant is supplied to a radiator (not shown in FIGS.) from the thermostat chamber 25. Said coolant cooled by said radiator is recycled again to the suction port 20 of the coolant pump 15**.

Furthermore, the thermostat chamber 25 is connected to a by-pass coolant passage (not shown in FIGS.), which applies directly the coolant to the coolant jackets of each cylinder without flowing through the radiator. When the coolant temperature in the thermostat chamber 25 is lower than a required temperature, the coolant passage toward the radiator is closed to circulate the coolant to each cylinder from said by-pass passage.

The V-type engine is additionally arranged with a number of externally located components or accessories including the carburator 33, fuel pump, controlling equipment and the like in the space defined by the V-bank of the cylinders 1 and 2 as shown by double dotted line 33 in FIGS. 1 and 2. Also, the coolant passage 31 connected to the coolant jacket outlet consists of a piping member, which forms integrally therein an intake passage 32 supplying the air-fuel mixture into each cylinder.

In the construction of the embodiment explained in the above, the coolant pump 15 is arranged on the bottom wall of the crankcase 13 descended from the V-bank, as seen in FIGS. 1 and 2, but if there is space in the side direction of each cylinder, said coolant pump 15 can be secured on a periphery of the crankcase.

As shown in the above, since the coolant pump 15 is secured in some place outward of a bearing portion of the crankshaft 6, it can be obtained a simply and compactly constructed cooling system without complicating the constitution between the cylinders 1 and 2 (within the V-bank) and increasing the size of the engine.

Furthermore, according to the invention, the coolant pump 15 is mounted in a position away from the rows of both cylinders in the axial direction of the crankshaft 6, while the coolant jacket inlets **23*a* are provided in the side of the coolant pump 15 of each cylinder. As a result of this, the distribution of the coolant can be carried out over a minimal distance vice the coolant inlet manifold 23 on the outside without forming a distributing passage within the cylinder blocks and there is no tendency of the internal construction of the cylinder blocks to be complicated and further a compact and inexpensive construction of the coolant passage can be realized. Therefore, it is easy to accomplish the processing of the inlet port, that is the coolant jacket inlets in the side of the cylinders 1 and 2** and can be moulded economically without using a core.

Moreover, in OHV engine as illustrated in FIGS. 1 and 2, the camshaft 45 is provided on the bottom portion within the V-bank, while the coolant pump 15 is driven with said camshaft 45, whereby a driving system for exclusive use of the coolant pump 15 can be omitted, and therefore, a very compact, economical construction can be realized.

Particularly, in the vertical shaft V-type engine as shown in FIGS. 1 and 2, the bearing case on the lower side of the crankcase 13 is used as an engine mount and an oil pan, and the coolant pump 15 can be mounted with the use of excess space, which is defined around said bearing case, whereby the engine can be constituted compactly, while an air accumulation in the coolant in the coolant pump 15 or its vicinity can be prevented because the coolant pump 15 can be located on the lowest level. Also, maintenance of the carburetor, fuel pump and controlling system in the space defined within the V-bank and maintenance of the coolant pump in itself can be obtained easily.

Figure 3:
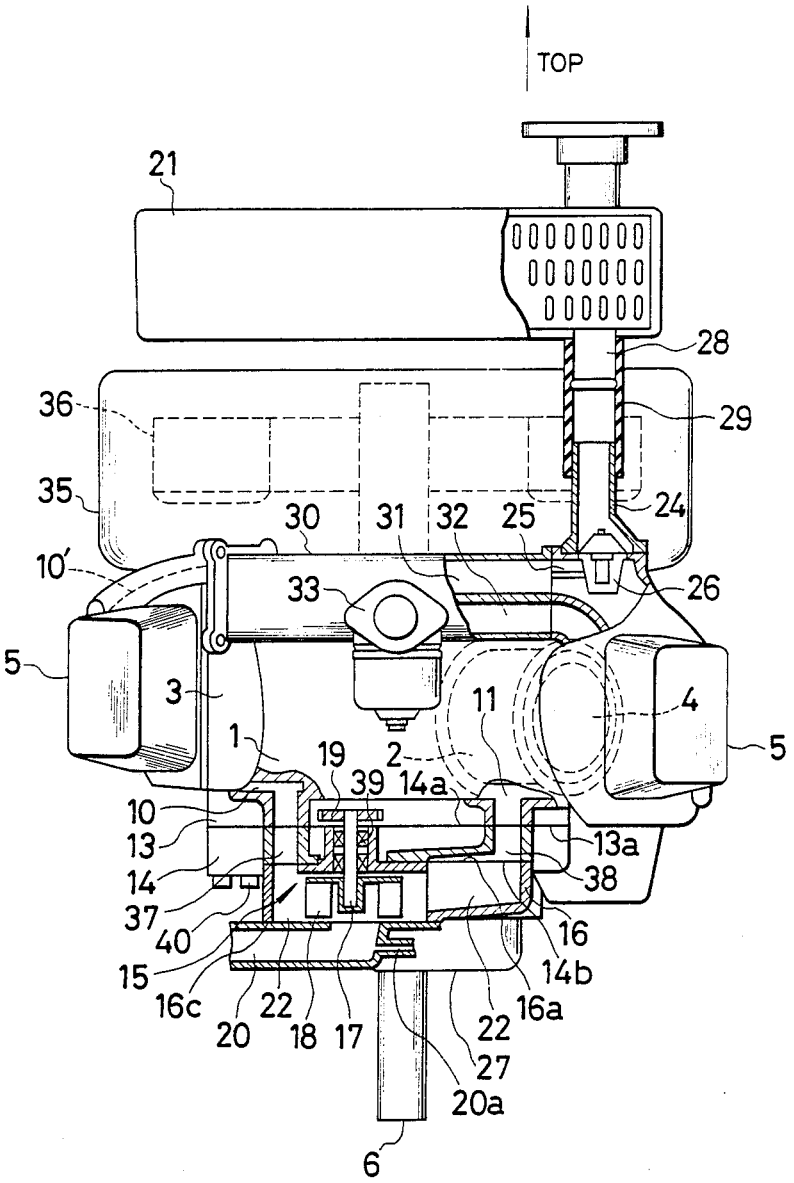
FIG. 3 is a front view partly broken of a vertical shaft V-type liquid cooled engine showing a modified structure of the cooling system according to the invention, which is observed from the direction of arrow I in the FIG. 4.
Figure 4:
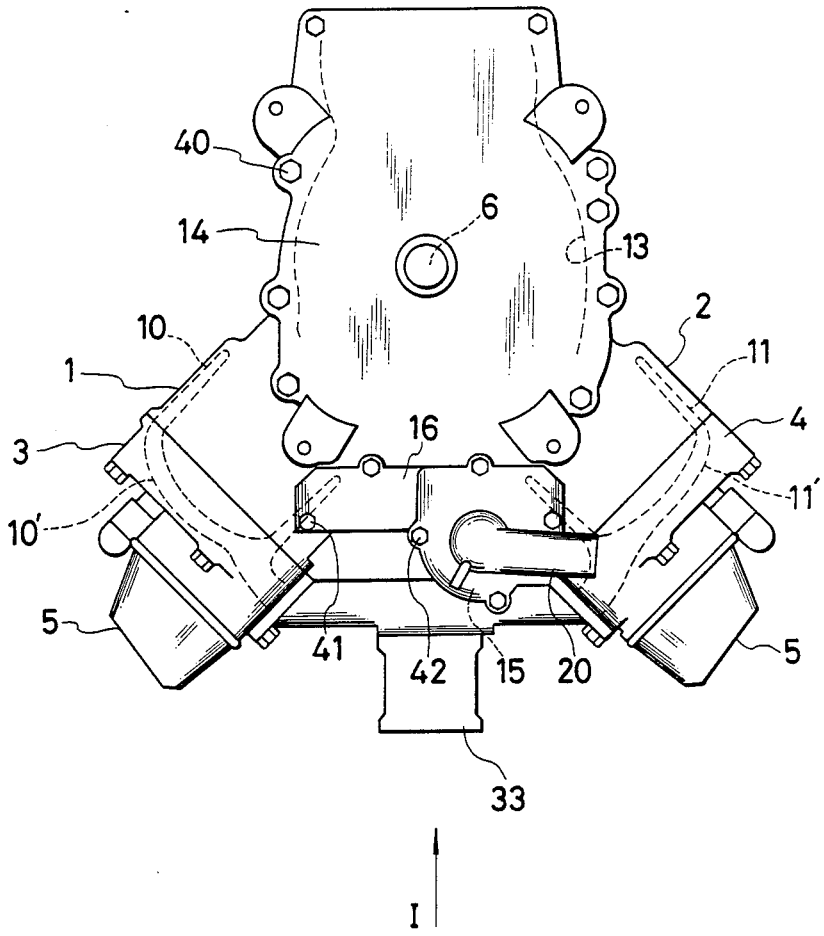
FIG. 4 is a plane view of the engine shown in FIG. 3.

A modified construction according to the invention shows in FIGS. 3 and 4. The same component parts in FIGS. 3 and 4 are indicated with the use of the same numerals as those in FIGS. 1 and 2.

In FIGS. 3 and 4, the left and right cylinders 1 and 2, respectively are provided with cylinder heads 3 and 4 and a head cover (rocker arm cover) 5, and coolant jackets 10, 10' and 11, 11' are formed between a pair formed of the left cylinder 1 and the cylinder heads 3, and a pair formed of the right cylinder 2 and the cylinder head 4, respectively. The crankcase 13 is open at a bottom surface thereof (back surface in FIG. 4), and a crankcase cover 14, which covers the open end of the crankcase 13 is secured to said bottom surface by a plurality of bolts 40.

The coolant pump 15 is arranged within the V-bank. In FIG. 3, the crankshaft 6 is arranged with a vertical axis, and the left cylinder 1 is arranged in a higher position than the right cylinder 2. The crankcase 13 is formed integrally with the cylinders 1 and 2. A bottom end inlet portion of each coolant jacket 10 and 11 of the crankcase 13 are opened downwardly at a bottom surface (joint face) 13*a* of the crankcase 13, and a top surface (joint face) 14*a* of a case cover 14 is associated with said bottom surface 13*a* by the bolts 40. A pair of left and right coolant passages 37 and 38 is formed in the crankcase cover 14, and connected directly to the bottom end inlet portion of the coolant jackets 10 and 11. The bottom end portion of the right coolant passage 38 is enlarged extending leftwardly in the orthogonal direction to the crankshaft 6 and opened downwardly. The left coolant passage 37 has substantially the same sectional area as the top end portion and is opened downwardly and extended downwardly. The bottom surface of the crankcase cover 14 has also a horizontal joint face 14*b*, said joint face 14*b* is associated with a horizontal joint face of top end 16*a* of the pump casing 16, and the crankcase 13 is secured with the case cover 14 by the bolts 41 (as shown in FIG. 4). The pump casing 16 is provided integrally with a bearing boss within the crankcase, and said boss supports rotatively a pump drive shaft 17 parallel with the crankshaft 6 through a shaft seal 39 and the like. A pump drive gear 19 is secured on the upper end portion of the pump shaft 17, and the impeller 18 is secured on the lower end portion thereof. The pump drive gear 19 is geared with a gear of the crankshaft 6 through, for example, a gear of the camshaft. Left and right distributing exit passages 22 are formed on half portions under the pump case 16, respectively, and said left exit passage 22 is positioned such that its upper surface opening portion is connected directly to the left coolant passage 37 of the crankcase cover 14. The right exit passage 22 is diverged largely rightwardly in orthogonal direction to the crankshaft 6 and is opened largely at the top surface thereof, and further said passage is connected directly to a bottom side of the right coolant passage 38 of the crankcase cover 14. That is, the right exit passage 22, which is extended rightwardly in orthogonal direction to the crankshaft 6 from the impeller 18 may be defined by using the joint face 14*b* of the cover 14 and the joint face 16*a* of the pump casing 16.

A joint face 16*c* of the bottom side of the pump casing 16 is associated with a joint face of the top side of pump casing cover 27, and said pump casing cover 27 is fitted together with the pump casing 16, the crankcase cover 14 and the crankcase 13 by bolts 42 (in FIG. 4). The suction port 20 is formed within the pump casing cover 27. Said suction port 20 is connected to an outlet portion of a radiator 21 above the engine through a pipe (not shown in FIG.). Furthermore, a small diameter by-pass inlet portion 20*a* is formed in the pump casing cover 27, and said inlet portion 20*a* is connected to the thermostat chamber 25, which is formed on the upper end of the coolant jacket 11' of the right cylinder head 4.

Said thermostat chamber 25 is provided with thermostat 26. An upper end portion of the thermostat chamber 25 is provided with an upward extended coolant outlet thermostat cover 24. The thermostat chamber 25 is accommodated in an upper coolant exit portion of the coolant jacket 10' of the left cylinder head 3 through a communicating passage 31, and a right end portion of said passage 31 is opened to the thermostat chamber 25. Said communicating passage 31 is formed within a communicating pipe 30, and an intake passage 32 is formed within said pipe 30 parallel with said passage 31. Said intake passage 32 accommodates intake valve ports of the left and light cylinder head 3 and 4, respectively, and the carburetor 33 is connected to a center portion between said intake valve ports. The carburetor 33 is connected to an air cleaner (not shown in FIG. 3). The radiator 21 is arranged in parallel upward of the engine, and an inlet port 28 is provided downwardly from the lower surface of the radiator 21 and provided directly over an upward cover 24 of the thermostat chamber 25. Said cover 24 is connected to said inlet port 28 by means of a linear rubber hose 29. The radiator 21 is supported elastically on the engine through a suitable bracket and an elastic member, and a radiator-cooling fan 36 is arranged between the radiator 21 and the upper surface of the engine. A numeral 35 indicates a fan housing.

In the operation of the cooling system of the modified construction as shown in the above, the coolant is sucked in the pump 15 through the suction port 20 from the radiator 21 by means of the rotation of the impeller 18 of the coolant pump 15, and said sucked coolant is discharged and supplied to the coolant jackets 10 and 11 of the left and right cylinders 1 and 2 through the left and right distributing exit passages 22, and the coolant passages 37 and 38 of the crankcase cover 14. Then, after having cooled the cylinders 1 and 2 with the coolant, said coolant is introduced into the coolant jackets 10' and 11' of the left and right cylinder heads 3 and 4, respectively to cool the cylinder heads 3 and 4, after which the coolant is applied to upper outlets of the coolant jacket 10' and 11', respectively. The coolant is discharged from the coolant jacket 11' of the lower, right cylinder head 4 is returned to the radiator 21 through the cover 24 and the rubber hose 29 from the thermostat chamber 25, while the other coolant discharged from the coolant jacket 10' of the higher, left cylinder head 3 is supplied to the thermostat chamber 25 through the communicating passage 31 and returned similarly to the radiator 21 through the cover 24 and the rubber hose 29.

The thermostat 26 detects the temperature of the coolant within the thermostat chamber 25 and opens when the coolant temperature is higher than a predetermined temperature, but closes when said coolant temperature is lower than said predetermined temperature. If closed, the coolant is recycled from the by-pass outlet portion of the thermostat chamber 25 to the by-pass inlet portion 20*a* of the coolant pump 15.

In the manufacture of the modified structure as illustrated in the above, the whole of the crankcase 13, crankcase cover 14, pump casing 16 and pump cover 27 may be formed, for example, by metal mould casting, and the pump casing 16 may be moulded from only an upper and lower direction of the metal mould.

Also, all surfaces of the coolant passage may be cast with a rough surface and the component parts may be produced therefore by high pressure-die casting in which air is entrapped and consequently one can prevent a leakage of the coolant, decrease the manufacture cost, and further eliminate plugs and the like. The crankcase 13 itself can also be manufactured by the high pressure-die casting process.

The advantages obtained according to the modified embodiment as shown in the above are as follows:

(1) The distributing exit passages extending from the suction port of the pump to the coolant jacket inlet port for each cylinder can be formed by the combination of each joint face of the crankcase-forming member (for example, the end faces of crankcase cover), the coolant pump casing and the pump casing cover, respectively, whereby the coolant passage can be formed by only assembly of the pump casing and the pump casing cover, and particularly, it does not require a hose piping for the coolant. Thus, one can achieve easily the assembly operation and decreased considerably the coolant leakage compared with the hose piping.

(2) Since the distributing exit passage extending substantially in orthogonal direction to the crankshaft axis and extending from the suction port to each coolant jacket, is formed by means of the joint faces of the crankcase-forming member, the pump casing and the pump casing cover, respectively, the coolant pump can be located apart to some extent from the drive shaft and as a result, it can be prevented to position the coolant jackets within the cylinders deeper than a desired depth by separating the coolant pump to a certain degree from the drive shaft. One may use a small-type coolant pump having small diameter in order to minimize the engine size.

(3) When the crankcase cover is used as the crankcase-forming member in order to form the distributing passage, the crankcase can be clamped together with the pump casing and the pump casing cover, whereby it can be decreased the step of assembly and the number of bolts to be used.

Although the invention was explained primarily with the embodiments of the cooling system applied a vertical shaft-type engine, it should be understood that the invention is not limited to the engine only as shown in the above, and can be applied to a horizontal shaft-type engine in which the crankshaft is arranged with a horizon axis. In this horizontal shaft-type engine, the coolant pump 15 can be secured in either side in the front and rear direction (axial direction of the crankshaft) of the V-bank between both cylinders in the substantially same condition.

Furthermore, the invention can be applied to a liquid cooling vertical shaft V-type engine having multiple cylinders, for example four, six or eight cylinders.

What is claimed is:

1. A cooling system in a V-type engine having a crankcase with cylinders arranged horizontally and so as to form a V therebetween, a bottom wall attached to said crankcase at a level lower than said cylinders, and a vertically arranged crankshaft substantially at the junction of the V; said cooling system comprising: a coolant pump having a pump shaft arranged parallel to said crankshaft, within the V spaced from the junction, and spaced from said cylinders vertically in axial direction of said crankshaft; said coolant pump being joined to a first face of said bottom wall of said crankcase and having outlet passages extending orthogonal to said crankshaft and ending at said first face of said bottom wall, separate cooling jackets mounted at said cylinders and having therein separate inlets at a second face of said bottom wall of said crankcase, and intermediate coolant passages provided within said bottom wall between said first and second faces and joining said outlet passages to said inlets of said cooling jackets.

2. A cooling system according to claim 1, wherein said first and second faces are opposite sides of said bottom wall of said crankcase, said coolant pump having a pump casing that encloses said coolant pump, said pump casing having one side thereof attached to said first face of said end wall and having a suction port to receive therethrough between coolant from an external source to supply said coolant pump; and distributing passages mounted between said first face of said bottom wall of said crankcase and said coolant pump and connected to join said intermediate coolant passages to an exit port of said coolant pump.

3. A cooling system according to claim 1, wherein said coolant pump is driven by a camshaft mounted in said crankcase at a location within the V spaced from the junction.

4. A cooling system in a V-type engine having a crankcase with cylinders arranged horizontally and so as to form a V therebetween, a bottom wall attached to said crankcase; and a vertically extending crankshaft substantially at the junction of the V; said cooling system comprising: a coolant pump having a pump shaft arranged parallel to, and being driven by, said crankshaft and mounted in said crankcase at a location within the V spaced from the junction, and at a lower level than said cylinders when looking in axial direction of said crankshaft; said coolant pump being joined to a first face of said bottom wall and having an outlet passage extending orthogonal to said crankshaft, and ending at said first face of said end wall, separate coolant jackets mounted at said cylinders and having therein separate inlets mounted at a second face of said bottom wall; and intermediate coolant passages mounted within said bottom wall between said first and second faces thereof and adapted to join said outlet passages to said inlets of said cooling jackets.

5. A cooling system according to claim 1 or 4, wherein said bottom wall is integrally formed with said crankcase.

* * * * *